US008514132B2

(12) United States Patent
Rao

(10) Patent No.: US 8,514,132 B2
(45) Date of Patent: Aug. 20, 2013

(54) COMPACT MULTIPLE-BAND ANTENNA FOR WIRELESS DEVICES

(75) Inventor: Qinjiang Rao, Waterloo (CA)

(73) Assignee: Research In Motion Limited, Waterloo, CA (US)

( * ) Notice: Subject to any disclaimer, the term of this patent is extended or adjusted under 35 U.S.C. 154(b) by 706 days.

(21) Appl. No.: 12/615,267

(22) Filed: Nov. 10, 2009

(65) Prior Publication Data

US 2011/0109515 A1 May 12, 2011

(51) Int. Cl.
*H01Q 1/24* (2006.01)

(52) U.S. Cl.
USPC ..... 343/700 MS; 343/702

(58) Field of Classification Search
USPC ..... 343/700 MS, 702, 725
See application file for complete search history.

(56) References Cited

U.S. PATENT DOCUMENTS

| | | | |
|---|---|---|---|
| 6,166,694 | A | 12/2000 | Ying |
| 6,329,951 | B1 | 12/2001 | Wen et al. |
| 6,343,208 | B1 | 1/2002 | Ying |
| 6,353,443 | B1 | 3/2002 | Ying |
| 6,408,190 | B1 | 6/2002 | Ying |
| 6,573,869 | B2 | 6/2003 | Moore |
| 6,614,400 | B2 | 9/2003 | Egorov |

(Continued)

FOREIGN PATENT DOCUMENTS

| | | |
|---|---|---|
| EP | 1973192 | 9/2008 |
| JP | 2002-111364 | 4/2002 |

(Continued)

OTHER PUBLICATIONS

Z. D. Liu, P.S. Hall and D. Wake , "Dual-Frequency Planar Inverted-F Antenna," *IEEE Trans. on Antenna and Propagation*, vol. 45. No. 9, pp. 1451-1457, Oct. 1997.

(Continued)

*Primary Examiner* — Robert Karacsony
(74) *Attorney, Agent, or Firm* — Moffat & Co.; Timothy Clise; Joseph Ulvr

(57) ABSTRACT

A compact multiple-band antenna for wireless devices having a plurality of operating frequency bands is provided. In one embodiment, a multiple-band antenna for a wireless device, comprises a ground area; a first radiating member having a first end, an intermediate portion and a second end and cooperatively receiving and substantially radiating RF signals at a first, second and third resonant frequency, wherein said first end of said first radiating member is electrically connected to said ground area and said intermediate portion is electrically connected to a first feed point; a second radiating member having a first end and a second end and cooperatively receiving and substantially radiating RF signals at a first, second and third resonant frequency, wherein said first end of said second radiating member is electrically connected to said second end of said first radiating member; a third radiating member having a first end and a second end and cooperatively receiving and substantially radiating RF signals at a first, second and third resonant frequency, wherein said first end of said third radiating member is electrically connected to said second end of said second radiating member; and a fourth radiating member having a first end, an intermediate portion and a second end and providing a fourth resonant frequency, wherein said first end of said fourth radiating member is electrically connected to said second end of said third radiating member, said intermediate portion of said fourth radiating member is electrically connected to a second feed point and said second end of said fourth radiating member is unconnected.

13 Claims, 8 Drawing Sheets

(56) References Cited

U.S. PATENT DOCUMENTS

| | | | | |
|---|---|---|---|---|
| 6,917,339 | B2 | 7/2005 | Li et al. | |
| 7,023,387 | B2 | 4/2006 | Wen et al. | |
| 7,161,541 | B2 | 1/2007 | Chen | |
| 7,183,982 | B2 | 2/2007 | Kadambi et al. | |
| 7,265,724 | B1 | 9/2007 | Tan et al. | |
| 7,551,142 | B1 | 6/2009 | Zhang et al. | |
| 2003/0025637 | A1 | 2/2003 | Mendolia et al. | |
| 2003/0112185 | A1 | 6/2003 | Fang et al. | |
| 2004/0008146 | A1 | 1/2004 | Ikegaya et al. | |
| 2004/0263396 | A1 | 12/2004 | Sung | |
| 2005/0264455 | A1* | 12/2005 | Talvitie et al. | 343/702 |
| 2006/0208949 | A1 | 9/2006 | Hirabayashi | |
| 2006/0270472 | A1 | 11/2006 | Chen et al. | |
| 2007/0010300 | A1 | 1/2007 | Xue et al. | |
| 2007/0182658 | A1 | 8/2007 | Ozden | |
| 2007/0229370 | A1 | 10/2007 | Tan et al. | |
| 2007/0296634 | A1 | 12/2007 | Popugaev et al. | |
| 2008/0055178 | A1 | 3/2008 | Kim et al. | |
| 2009/0109096 | A1 | 4/2009 | Hozouri | |

FOREIGN PATENT DOCUMENTS

| | | |
|---|---|---|
| JP | 2004-048119 | 2/2004 |
| JP | 2005-020691 | 1/2005 |
| JP | 2007-116519 | 5/2007 |
| JP | 2008-245282 | 10/2008 |
| WO | 2008122112 | 10/2008 |

OTHER PUBLICATIONS

C. R. Rowell and R. D. Murch, "A compact PIFA suitable for dual-frequency 900/1800-MHz operation," *IEEE Trans. on Antenna and Propagation*, vol. 46, pp. 586-598, Apr. 1998.

C. W. Chiu and F. L. Lin, "Compact dual-band PIFA with multi-resonators," *Electron Lett.*, vol. 38, pp. 538-554, 2002.

Y. X. Guo, M. Y. W. Chia and Z. N. Chen, Miniature built-in quad-band antennas for mobile handsets, IEEE Antennas Wireless Propag. Letters, vol. 2, pp. 30-32, 2003.

Zi Dong Liu, Peter S. Hall, and David Wake, Dual-Frequency Planar Inverted-F Antenna, *IEEE Transactions on Antennas and Propogation*, vol. 45, No. 10, Oct. 1997.

Yong-Xin Guo, M. Y. W. Chia and Z. N. Chen, Miniature Built-In Quad-Band Antennas for Mobile Handsets, *IEEE Antennas and Wireless Propogation Letters*, vol. 2, 2003.

Kin-Lu Wong, EMC and Thin Internal Planar Antennas for Mobile Devices, Dept. of Electrical Engineering, National Sun Yat-Sen University, Kaohsiung, Taiwan, e-mail: wongkl@ema.ee.nsysu.edu.tw , pp. 1-26.

Canadian Patent Application No. 2,720,512, Office Action mailed Feb 12, 2013.

Japanese Patent Application No. 2010-251300, Office Action mailed Jan 29, 2013.

Japanese Patent Application No. 2010-251300, Office Action mailed Sep. 10, 2012.

* cited by examiner

800

COMPACT MULTIPLE-BAND ANTENNA FOR WIRELESS DEVICES

CROSS-REFERENCE TO RELATED APPLICATIONS

There are no related applications.

FIELD

The invention generally relates to a wireless device in a wireless communication system and, in particular, to a compact multiple-band antenna for wireless devices.

BACKGROUND

Wireless communication systems are widely deployed to provide, for example, a broad range of voice and data-related services. Typical wireless communication systems consist of multiple-access communication networks that allow users of wireless devices to share common network resources. These networks typically require multiple-band antennas for transmitting and receiving radio frequency ("RF") signals from wireless devices. Examples of such networks are the global system for mobile communication ("GSM"), which operates between 890 MHz and 960 MHz; the digital communications system ("DCS"), which operates between 1710 MHz and 1880 MHz; the personal communication system ("PCS"), which operates between 1850 MHz and 1990 MHz; and the universal mobile telecommunications system ("UMTS"), which operates between 1920 MHz and 2170 MHz.

In addition, emerging and future wireless communication systems may require wireless devices to operate new modes of communication at different frequency bands to support, for instance, higher data rates, increased functionality and more users. Examples of these future systems are the single carrier frequency division multiple access ("SC-FDMA") system, the orthogonal frequency division multiple access ("OFDMA") system, and other like systems. An OFDMA system is supported by various technology standards such as evolved universal terrestrial radio access ("E-UTRA"), Wi-Fi, worldwide interoperability for microwave access ("WiMAX"), wireless broadband ("WiBro"), ultra mobile broadband ("UMB"), long-term evolution ("LTE"), and other similar standards.

Moreover, wireless devices may provide additional functionality that requires using other wireless communication systems that operate at different frequency bands. Examples of these other systems are the wireless local area network ("WLAN") system, the IEEE 802.11b system and the Bluetooth system, which operate between 2400 MHz and 2484 MHz; the WLAN system, the IEEE 802.11a system and the HiperLAN system, which operate between 5150 MHz and 5350 MHz; the global positioning system ("GPS"), which operates at 1575 MHz; and other like systems.

To satisfy consumer demand for multiple-modes and multiple-functions while maintaining or reducing the form factor, weight or both of wireless devices, manufacturers are continually striving to reduce the size of components contained in these wireless devices. One of these components is an antenna, which is required by wireless devices for wireless communication. These wireless devices typically use multiple antennas for operation at various frequency bands. Further, consumer aesthetic preferences typically require that an antenna be contained within the wireless device, as opposed to an external retractable antenna or antenna stub that is visible to the user. It is also desirable to incorporate the antenna within the wireless device for reasons of size, weight and durability. Therefore, antennas typically have been a major focus for miniaturization in wireless devices.

A miniaturized antenna radiating structure, such as a planar inverted-F antenna ("PIFA"), uses a microstrip patch antenna and is typically installed within a wireless device. Patch antennas are popular for use in wireless devices due to their low profile, ability to conform to surface profiles and unlimited shapes and sizes. Patch antenna polarization can be linear or elliptical, with a main polarization component parallel to the surface of the patch antenna. Operating characteristics of patch antennas are predominantly established by their shape and dimensions. The patch antenna is typically fabricated using printed-circuit techniques and integrated with a printed circuit board ("PCB"). The patch antenna is typically electrically coupled to a ground area, wherein the ground area is typically formed on or in a PCB. Patch antennas are typically spaced from and parallel to the ground area and are typically located near other electronic components, ground planes and signal traces, which may impact the design and performance of the antenna. In addition, PIFAs are typically considered to be lightweight, compact, and relatively easy to manufacture and integrate into a wireless device.

PIFA designs can include one or more slots in the PIFA's radiating member. Selection of the position, shape, contour and length of a slot depends on the design requirements of the particular PIFA. The function of a slot in a PIFA design includes physically partitioning the radiating member of a single-band PIFA into a subset of radiating members for multiple-band operation, providing reactive loading to modify the resonant frequencies of a radiating member, and controlling the polarization characteristics of a multiple-band PIFA. In addition to a slot, radiating members of a PIFA can have stub members, usually consisting of a tab at the end of a radiating member. The function of a stub member includes providing reactive loading to modify the resonant frequencies of a radiating member.

Accordingly, a compact multiple-band antenna is a critical component in supporting these multiple-mode, multiple-function wireless devices. It is desirable for an antenna used in a multiple-mode, multiple-function wireless device to include efficient omni-directional broadband performance. It is also desirable for such an antenna to have multiple-band performance, including non-overlapping frequency bands that may be substantially separated in frequency. In addition, it is desirable for such an antenna to be lightweight with a small form factor that can fit within a wireless device. Finally, it is desirable for such an antenna to be low cost, and easily manufactured and installed into a wireless device.

BRIEF DESCRIPTION OF THE DRAWINGS

In order for this disclosure to be understood and put into practice by one having ordinary skill in the art, reference is now made to exemplary embodiments as illustrated by reference to the accompanying figures. Like reference numbers refer to identical or functionally similar elements throughout the accompanying figures. The figures along with the detailed description are incorporated and form part of the specification and serve to further illustrate exemplary embodiments and explain various principles and advantages, in accordance with this disclosure, where.

Figure 1:
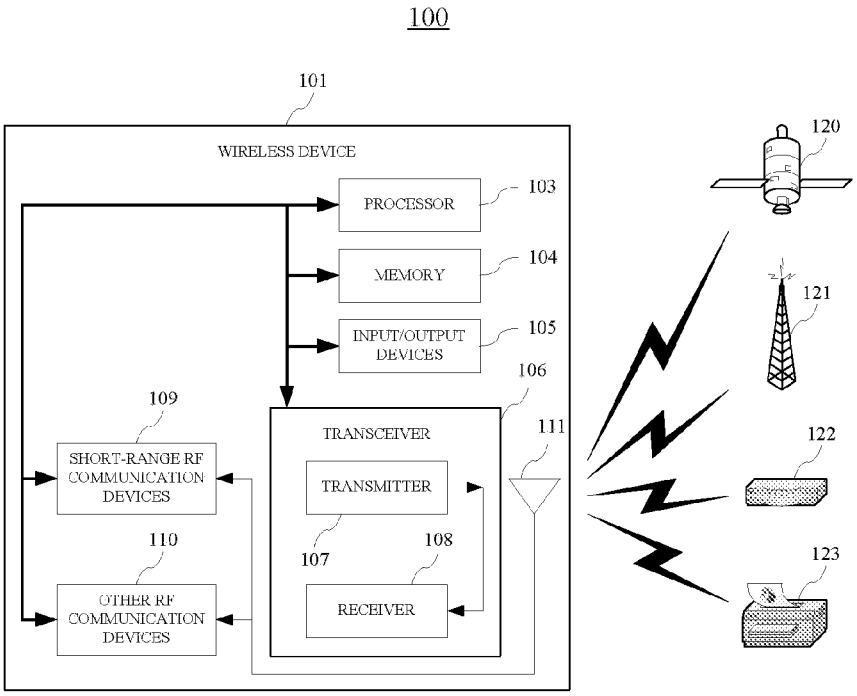
FIG. 1 (PRIOR ART)
FIG. 1 illustrates a wireless communication system in accordance with various aspects set forth herein.

Skilled artisans will appreciate that elements in the accompanying figures are illustrated for clarity, simplicity and to further help improve understanding of the embodiments, and have not necessarily been drawn to scale.

DETAILED DESCRIPTION

Although the following discloses exemplary methods, devices and systems for use in wireless communication systems, it will be understood by one of ordinary skill in the art that the teachings of this disclosure are in no way limited to the examplaries shown. On the contrary, it is contemplated that the teachings of this disclosure may be implemented in alternative configurations and environments. For example, although the exemplary methods, devices and systems described herein are described in conjunction with a configuration for aforementioned wireless communication systems, those of ordinary skill in the art will readily recognize that the exemplary methods, devices and systems may be used in other wireless communication systems and may be configured to correspond to such other systems as needed. Accordingly, while the following describes exemplary methods, devices and systems of use thereof, persons of ordinary skill in the art will appreciate that the disclosed examplaries are not the only way to implement such methods, devices and systems, and the drawings and descriptions should be regarded as illustrative in nature and not restrictive.

Various techniques described herein can be used for various wireless communication systems. The various aspects described herein are presented as methods, devices and systems that can include a number of components, elements, members, modules, peripherals, or the like. Further, these methods, devices and systems can include or not include additional components, elements, members, modules, peripherals, or the like. It is important to note that the terms "network" and "system" can be used interchangeably. Relational terms described herein such as "above" and "below", "left" and "right", "first" and "second", and the like may be used solely to distinguish one entity or action from another entity or action without necessarily requiring or implying any actual such relationship or order between such entities or actions. The term "or" is intended to mean an inclusive "or" rather than an exclusive "or." Further, the terms "a" and "an" are intended to mean one or more unless specified otherwise or clear from the context to be directed to a singular form. The term "electrical coupling" as described herein, which is also referred to as "capacitive coupling," "inductive coupling" or both, comprises at least coupling via electric and magnetic fields, including over an electrically insulating area. The term "electrically connected" as described herein comprises at least by means of a conducting path, or through a capacitor, as distinguished from connected merely through electromagnetic induction.

Wireless communication networks consist of a plurality of wireless devices and a plurality of base stations. A base station may also be called a node-B ("NodeB"), a base transceiver station ("BTS"), an access point ("AP"), a satellite, a router, or some other equivalent terminology. A base station typically contains one or more RF transmitters, RF receivers or both electrically connected to one or more antennas to communicate with wireless devices.

A wireless device used in a wireless communication network may also be referred to as a mobile station ("MS"), a terminal, a cellular phone, a cellular handset, a personal digital assistant ("PDA"), a smartphone, a handheld computer, a desktop computer, a laptop computer, a tablet computer, a printer, a set-top box, a television, a wireless appliance, or some other equivalent terminology. A wireless device may contain one or more RF transmitters, RF receivers or both electrically connected to one or more antennas to communicate with a base station. Further, a wireless device may be fixed or mobile and may have the ability to move through a wireless communication network.

FIG. 1 is a block diagram of system 100 for wireless communication in accordance with various aspects described herein. In one embodiment, system 100 can include one or more multiple-mode, multiple-functional wireless devices 101, one or more satellites 120, one or more base stations 121, one or more access points 122, and one or more other wireless devices 123. In accordance with one aspect, wireless device 101 can include processor 103 electrically connected to memory 104, input/output devices 105, transceiver 106, short-range RF communication devices 109 or other RF communication devices 110 or any combination thereof, which can be utilized by wireless device 101 to implement various aspects described herein. Processor 103 typically manages and controls the overall operation of the wireless device. Transceiver 106 of wireless device 101 includes one or more transmitters 107 and one or more receivers 108. Further, associated with wireless device 101, one or more transmitters 107, one or more receivers 108, one or more short-range RF communication devices 109 and other RF communication devices 110 are electrically connected to one or more antennas 111.

In the current embodiment, wireless device 101 is capable of two-way voice and data communications with base station 121. The voice and data communications may be associated with the same or different networks using the same or different base station 121. The detailed design of transceiver 106 is dependent on the wireless communication network used. When wireless device 101 is operating two-way data communication with base station 121, a text message, for instance, is received at antenna 111, processed by receiver 108 of transceiver 106 and provided to processor 103.

Short-range RF communication devices 109 may also be integrated in wireless device 101. For example, short-range RF communication devices 109 may include a Bluetooth module or a WLAN module. Short-range RF communication devices 109 may use antenna 111 for transmitting RF signals, receiving RF signals or both. The Bluetooth module can use antenna 111 to communicate, for instance, with one or more other wireless devices 123 such as a Bluetooth-capable printer. Further, the WLAN module may use antenna 111 to communicate with one or more access points 122, routers or other similar devices.

In addition, other RF communication devices 110 may also be integrated in wireless device 101. For example, other RF communication devices 110 may include a GPS receiver that uses antenna 111 of wireless device 101 to receive information from one or more GPS satellites 120. Further, other RF communication devices 110 may use antenna 111 of wireless device 101 for transmitting RF signals, receiving RF signals or both.

Figure 2:
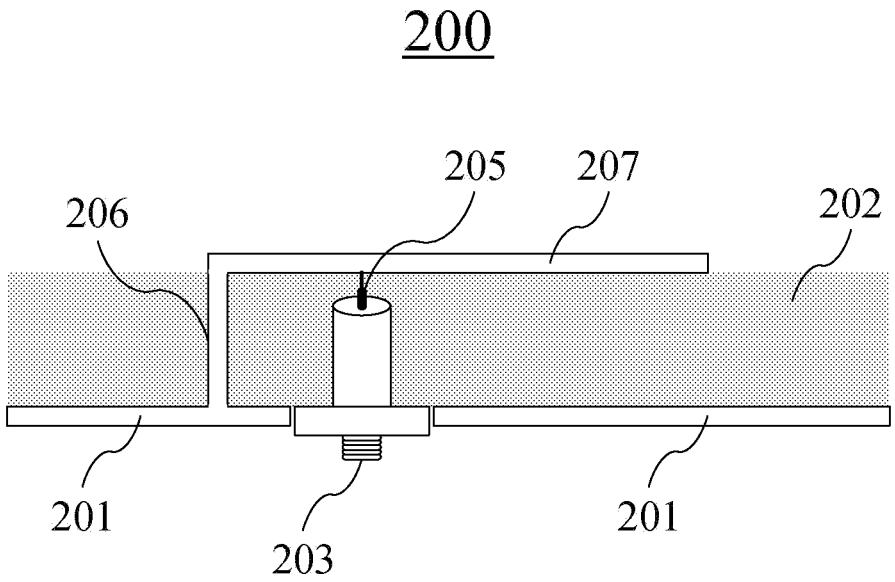
FIG. 2 (PRIOR ART)
FIG. 2 illustrates a cross-sectional view of a PIFA that can be employed in a wireless device in accordance with various aspects set forth herein.

FIG. 2 illustrates a cross-sectional view of PIFA 200 that can be employed in a wireless device in accordance with various aspects set forth herein. PIFA 200 includes ground area 201, dielectric material 202, feeding device 203, feed point 205, shorting member 206, and radiating member 207. In one embodiment, PIFA 200 is a single-band antenna having one operating frequency band associated with radiating member 207.

Dielectric material 202 resides between radiating member 207 and ground area 201 and is used to further isolate radiating member 207 from ground area 201. Dielectric material 202 can be, for example, the air, a substrate or a polystyrene or any combination thereof. Radiating member 207 is electrically connected to ground area 201 through shorting member 206. Radiating member 207 can be made from, for instance, metallic materials.

Feed point 205 can be, for example, a microstrip feed line, a probe feed, an aperture-coupled feed or a proximity-coupled feed. In this embodiment, feed point 205 can be electrically connected to radiating member 207 using feeding device 203. Feeding device 203 can be, for instance, set on the surface of the ground area 201 and electrically connected to feed point 205 for transmitting RF signals, receiving RF signals or both. Feeding device 203 can be, for example, a sub-miniature version A ("SMA") connector. SMA connectors are coaxial RF connectors developed as a minimal connector interface for a coaxial cable with a screw type coupling mechanism. SMA connectors typically have a 50 ohm impedance and offer excellent electrical performance over a broad frequency range.

The length of PIFA 200 typically can be as short as approximately one-quarter the wavelength of the desired resonant frequency. One skilled in the art will appreciate that the length of a radiating member of the present disclosure is not limited to one-quarter the wavelength of the desired resonant frequency, but other lengths may be chosen, such as one-half the wavelength of the desired resonant frequency.

Figure 3:
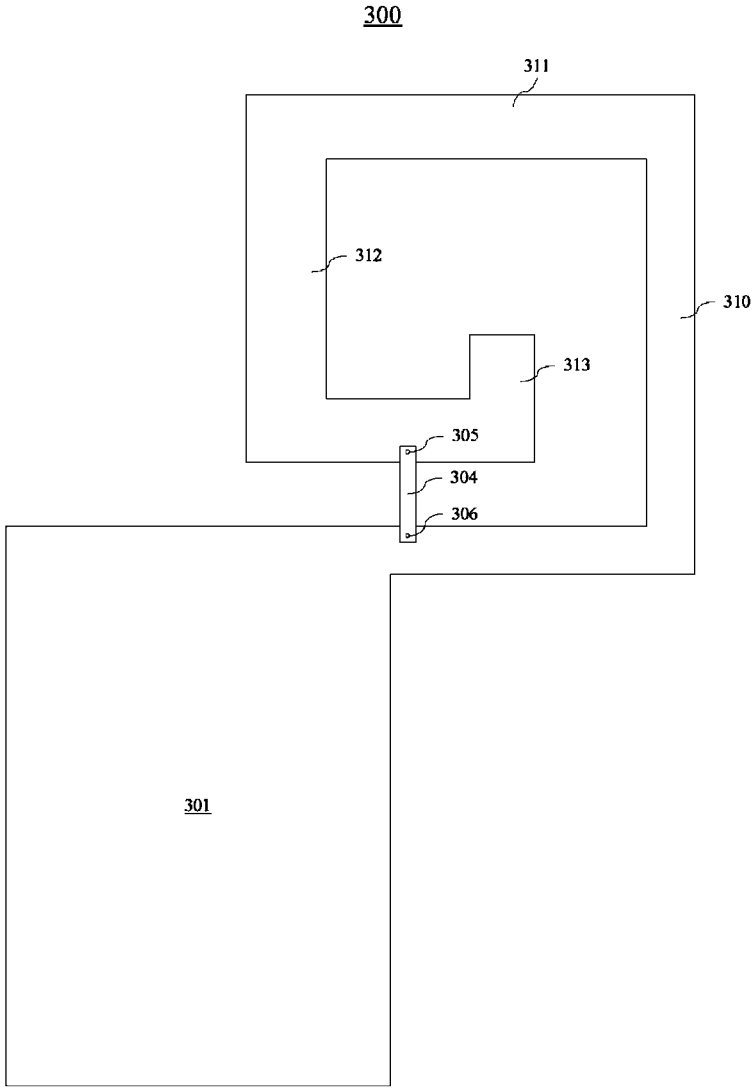
FIG. 3 illustrates a top view of one embodiment of a multiple-band antenna that can be employed in a wireless device in accordance with various aspects set forth herein.

FIG. 3 illustrates a top view of one embodiment of an exemplary multiple-band antenna 300 that can be employed in a wireless device in accordance with various aspects set forth herein. Multiple-band antenna 300 includes ground area 301; feeding device 303; first and second feed points 304 and 305, respectively; and first, second, third and fourth radiating members 310, 311, 312 and 313, respectively. First, second and third radiating members 310, 311 and 312, respectively, form a first antenna type, while fourth radiating member 313 forms a second antenna type. In one embodiment, first, second and third radiating members 310, 311 and 312, respectively, form a PIFA with a rectangular spiral strip with non-uniform widths as the first antenna type, while fourth radiating member 313 forms a PIFA with an L-shaped slot as the second antenna type. In other embodiments, first, second and third radiating members 310, 311 and 312, respectively, can form a PIFA with a rectangular spiral strip or a loop antenna as the first antenna type. In addition, fourth radiating member 313 can form a monopole antenna or a PIFA as the second antenna type. Those skilled in the art will recognize that a PIFA with a rectangular spiral strip can have radiating members with or without non-uniform widths.

In the current embodiment, RF signals in the operating frequency bands are received and radiated by multiple-band antenna 300 of wireless device 101. An RF signal in one of the operating frequency bands is received by multiple-band antenna 300 and converted from an electromagnetic signal to an electrical signal for input to receiver 108 of transceiver 106, short-range RF communication device 109 or other RF communication device 110 or any combination thereof, which is differentially and electrically connected to first feed point 304 and second feed point 305. Similarly, an electrical signal in one of the operating frequency bands is input to multiple-band antenna 300 for conversion to an electromagnetic signal via first feed point 304 and second feed point 305, which are differentially and electrically connected to transmitter 107 of transceiver 106, short-range RF communication device 109 or other RF communication device 110 or any combination thereof.

In one embodiment, multiple-band antenna 300 is a quad-band antenna having first, second, third and fourth operating frequency bands. First, second, third and fourth radiating members 310, 311, 312 and 313, respectively, are primarily associated with first, second, third and fourth operating frequency bands, respectively.

Those skilled in the art will appreciate that this disclosure is not limited to four operating frequency bands or to any interrelationship between the frequency bands and the radiating members. For example, the first operating frequency band could be common between first and second radiating members 310 and 311, respectively. Other associations between radiating members and operating frequency bands are also possible. Further, multiple-band antenna 300 can include more or less elements to provide for operation in more or less frequency bands, respectively.

In another embodiment, when operating in the first frequency band, first, second and third radiating members 310, 311 and 312, respectively, of multiple-band antenna 300 cooperatively receive and substantially radiate RF signals in directions parallel, perpendicular or both to first radiating member 310. When operating in the second frequency band, first, second and third radiating members 310, 311 and 312 of multiple-band antenna 300 cooperatively receive and substantially radiate RF signals in directions parallel, perpendicular or both to first and second radiating members 310 and 311, respectively. When operating in the third frequency band, first, second and third radiating members 310, 311 and 312 of multiple-band antenna 300 cooperatively receive and substantially radiate RF signals in directions parallel, perpendicular or both to first, second and third radiating members 310, 311 and 312, respectively. When operating in the fourth frequency band, fourth radiating member 313 of multiple-band antenna 300 receives and substantially radiates RF signals in directions parallel, perpendicular or both to fourth radiating member 313.

In another embodiment, first, second and third radiating members 310, 311 and 312, respectively, of multiple-band antenna 300 function as a loop antenna. A loop antenna provides usable radiation properties when operating at its resonance frequencies. The RF signal is fed or taken between first and second feed points 304 and 305, respectively, of feeding device 303. When operating in the first, second and third frequency bands, first, second and third radiating members 310, 311 and 312, respectively, of multiple-band antenna 300 cooperatively receive and substantially radiate RF signals in directions parallel, perpendicular or both to first, second and third radiating members 310, 311 and 312, respectively. When operating in the fourth frequency band, fourth radiating member 313 of multiple-band antenna 300 receives and substantially radiates RF signals in directions parallel, perpendicular or both to fourth radiating member 313.

It is important to note that persons having ordinary skill in the art would appreciate that changes to one element of multiple-band antenna 300 may also affect other operating frequency bands associated with other elements of multiple-band antenna 300. Further, elements of multiple-band antenna 300 described herein are sized and shaped to conform to specific design characteristics for operation in multiple frequency bands. In the current embodiment of multiple-band antenna 300, first radiating member 310 is primarily associated with a first resonant frequency. The first resonant frequency can correspond, for instance, to a frequency within the frequency band defined for GSM. Those skilled in the art will appreciate that the GSM band adopted in Europe and parts of Asia ("GSM-900") includes a transmit sub-band of 880 MHz to 915 MHz and receive sub-band from 925 MHz to 960 MHz. The GSM band adopted in North America ("GSM-800") includes transmit sub-bands of 824 MHz to 849 MHz and 896 MHz to 901 MHz and receive sub-bands of 869 MHz to 894 MHz and 935 MHz to 940 MHz. Further, the DCS frequency band similarly includes a transmit sub-band of 1710 MHz to 1785 MHz and a receive sub-band of 1805 MHz to 1880 MHz, and the PCS frequency band includes a transmit sub-band 1850 to 1910 MHz and a receive sub-band from 1930 MHz to 1990 MHz.

It is important to note that persons having ordinary skill in the art would appreciate that the operating frequency bands described are for illustrative purposes. Such a multiple-band antenna may be designed to operate at different, as well as more or less operating frequency bands.

First radiating member 310 has a first end, an intermediate portion and a second end. The first end of first radiating member 310 is electrically connected to ground area 301. The intermediate portion of first radiating member 310 is electrically connected to first feed point 304 of feeding device 303. First feed point 304 can be, for example, a microstrip feed line, a probe feed, an aperture-coupled feed or a proximity-coupled feed. The second end of first radiating member 310 is electrically connected to the first end of second radiating member 311. The length of first radiating member 310 is approximately one-quarter the wavelength of the first resonant frequency. One skilled in the art will appreciate that the length of a radiating member of the present disclosure is not limited to one-quarter the wavelength of the desired resonant frequency, but other lengths may be chosen, such as one-half the wavelength of the desired resonant frequency.

Second radiating member 311 has a first end and a second end. The first end of second radiating member 311 is electrically connected to the second end of first radiating member 310. The second end of second radiating member 311 is electrically connected to the first end of third radiating member 312. Second radiating member 311 is primarily associated with a second resonant frequency. The second resonant frequency can correspond, for instance, to a frequency within the frequency band defined for DCS. The length of second radiating member 311 is approximately one-quarter the wavelength of the second resonant frequency.

Third radiating member 312 has a first end and a second end. The first end of third radiating member 312 is electrically connected to the second end of second radiating member 311. The second end of third radiating member 312 is electrically connected to a first end of fourth radiating member 313. Third radiating member 312 is primarily associated with the third resonant frequency. The third resonant frequency can correspond, for instance, to a frequency within the frequency band defined for PCS, UMTS, LTE, WiBro, Bluetooth, WLAN or GPS. The length of third radiating member 312 is approximately one-quarter the wavelength of the third resonant frequency.

Fourth radiating member 313 has a first end, an intermediate portion and a second end. The first end of fourth radiating member 313 is electrically connected to the second end of third radiating member 312. The intermediate portion of fourth radiating member 313 is electrically connected to second feed point 305 of feeding device 303. Second feed point 305 can be, for example, a microstrip feed line, a probe feed, an aperture-coupled feed or a proximity-coupled feed. Further, the second end of fourth radiating member 313 is a free end and unconnected.

Fourth radiating member 313 is primarily associated with a fourth resonant frequency. The fourth resonant frequency can correspond, for instance, to a frequency within the frequency band defined for WLAN. The length of fourth radiating member 313 is approximately one-quarter the wavelength of the fourth resonant frequency. The distance between second feed point 305 and the second end of fourth radiating member 313 affects the fourth resonant frequency. The shorter the distance between second feed point 305 and the second end of fourth radiating member 313, the greater the fourth resonant frequency. Alternatively, the longer the distance between second feed point 305 and the second end of fourth radiating member 313, the smaller the fourth resonant frequency.

Figure 4:
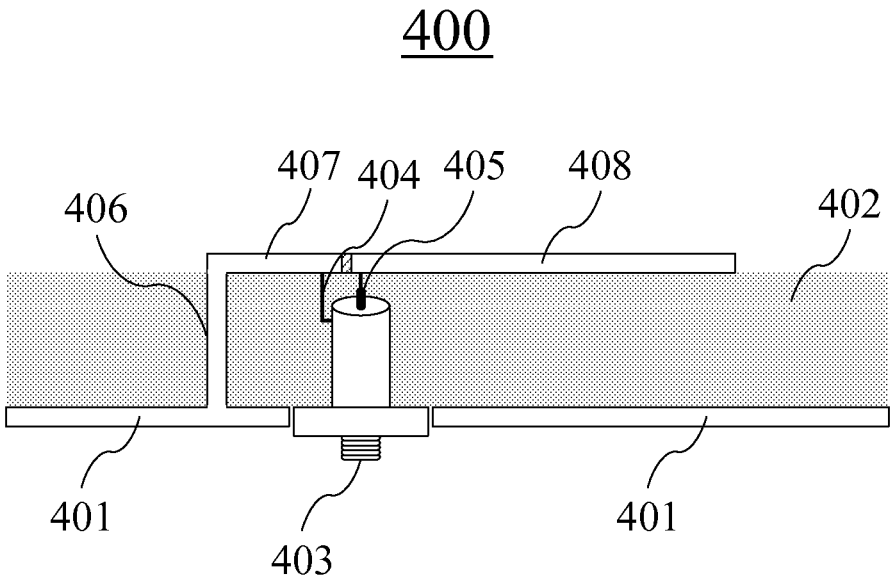
FIG. 4 illustrates a cross-sectional view of a compact multiple-band antenna that can be employed in a wireless device in accordance with various aspects set forth herein.

FIG. 4 illustrates a cross-sectional view of an exemplary compact multiple-band antenna 400 that can be employed in wireless device 101 in accordance with various aspects set forth herein. Multiple-band antenna 400 includes ground area 401; dielectric material 402; feeding device 403; first and second feed points 404 and 405, respectively; shorting member 406; and first and second radiating members 407 and 408, respectively. In one embodiment, compact multiple-band antenna 400 is a multiple-band antenna having multiple operating frequency bands associated with first and second radiating members 207 and 208, respectively. Dielectric material 402 resides between first and second radiating members 407 and 408, respectively, and ground area 401; and is used to isolate first and second radiating members 407 and 408, respectively, from the ground area 401. Dielectric material 402 can be, for example, the air, a substrate or a polystyrene or any combination thereof.

In this embodiment, first and second radiating members 407 and 408, respectively, are electrically connected to ground area 401 through shorting member 406. First and second radiating members 407 and 408, respectively, and shorting member 406 can be made, for instance, from metallic materials. First and second feed points 404 and 405, respectively, can be, for example, a microstrip feed line, a probe feed, an aperture-coupled feed or a proximity-coupled feed. In this embodiment, first and second feed points 404 and 405, respectively, are electrically connected to first and second radiating members 407 and 408, respectively, using feeding device 403. Feeding device 403 can be, for instance, set on the surface of ground area 401 and electrically connected to first and second feed points 404 and 405, respectively, for transmitting RF signals, receiving RF signals or both. Feeding device 403 can be, for example, an SMA connector. The lengths of first and second radiating members 407 and 408, respectively, can be as short as approximately one-quarter the wavelength of the desired resonant frequency.

Figure 5:
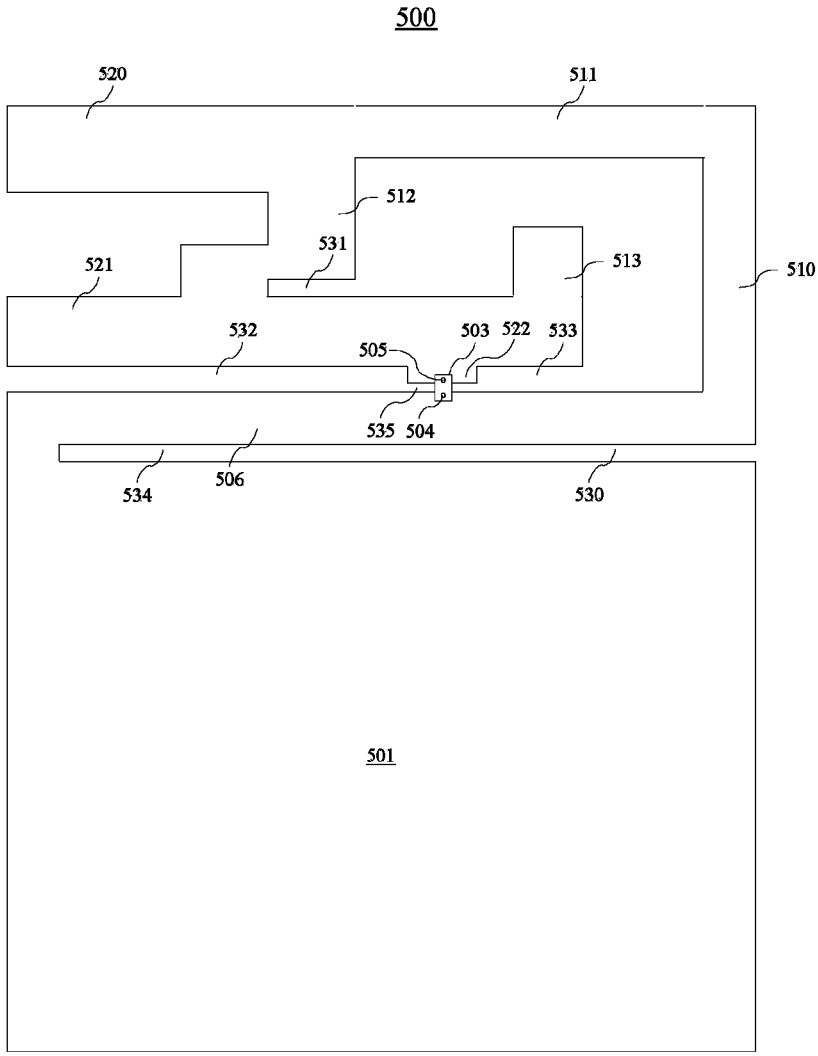
FIG. 5 illustrates a top view of one embodiment of a compact multiple-band antenna that can be employed in a wireless device in accordance with various aspects set forth herein.

FIG. 5 illustrates a top view of an exemplary compact multiple-band antenna 500 that can be employed in a wireless device in accordance with various aspects set forth herein. Compact multiple-band antenna 500 includes ground area 501; feeding device 503; first and second feed points 504 and 505, respectively; shorting member 506; first, second, third and fourth radiating members 510, 511, 512 and 513, respectively; first, second and third stub members 520, 521 and 522, respectively; first, second, third, fourth, fifth and sixth coupling slots 530, 531, 532, 533, 534, and 535, respectively. In compact multiple-band antenna 500, first, second, third and fourth radiating members 510, 511, 512 and 513, respectively, are primarily associated with first, second, third and fourth operating frequency bands, respectively. First, second and third radiating members 510, 511 and 512, respectively, form a first antenna type, while fourth radiating member 513 forms a second antenna type. In one embodiment, first, second and third radiating members 510, 511 and 512, respectively, form a PIFA with a rectangular spiral strip with non-uniform widths as the first antenna type, while fourth radiating member 513 forms a PIFA with an L-shaped slot as the second antenna type. In other embodiments, first, second and third radiating members 510, 511 and 512, respectively, can form a PIFA with a rectangular spiral strip or a loop antenna as the first antenna type. In addition, fourth radiating member 513 can form a monopole antenna or a PIFA as the second antenna type. Those skilled in the art will recognize that a PIFA with a rectangular spiral strip can have radiating members with or without non-uniform widths.

First and second feed points 504 and 505, respectively, can be, for example, a microstrip feed line, a probe feed, an aperture-coupled feed or a proximity-coupled feed. In this embodiment, first and second feed points 504 and 505, respectively, are electrically connected to first and second radiating members 510 and 513, respectively, using feeding device 503. Feeding device 503 can be, for instance, set on the surface of ground area 501 and electrically connected to first and second feed points 504 and 505, respectively, for transmitting RF signals, receiving RF signals or both. Feeding device 503 can be, for example, an SMA connector.

Shorting member 506; first, second and third stub members 520, 521 and 522, respectively; and first, second, third, fourth, fifth and sixth coupling slots 530, 531, 532, 533, 534 and 535, respectively, can be used for tuning the operating characteristics of compact multiple-band antenna 500.

In the current embodiment, RF signals in the operating frequency bands are received and radiated by compact multiple-band antenna 500 of wireless device 101. An RF signal in one of the operating frequency bands is received by compact multiple-band antenna 500 and converted from an electromagnetic signal to an electrical signal for input to receiver 108 of transceiver 106, short-range RF communication device 109 or other RF communication device 110 or any combination thereof, which are differentially and electrically connected to first feed point 504 and second feed point 505. Similarly, an electrical signal in one of the operating frequency bands is input to compact multiple-band antenna 500 for conversion to an electromagnetic signal via first feed point 504 and second feed point 505, which are differentially and electrically connected to transmitter 107 of transceiver 106, short-range RF communication device 109 or other RF communication device 110 or any combination thereof.

Those skilled in the art will appreciate that this disclosure is not limited to four operating frequency bands or to any interrelationship between the frequency bands and the radiating members. For example, the first operating frequency band could be common between first and second radiating members 510 and 511, respectively. Other associations between radiating members and operating frequency bands are also possible. Further, compact multiple-band antenna 500 can include more or less elements to provide for operation in more or less frequency bands, respectively.

In one embodiment, when operating in the first frequency band, first, second and third radiating members 510, 511 and 512, respectively, of compact multiple-band antenna 500 cooperatively receive and substantially radiate RF signals in directions parallel, perpendicular or both to first radiating member 510. When operating in the second frequency band, first, second and third radiating members 510, 511 and 512, respectively, of compact multiple-band antenna 500 cooperatively receive and substantially radiate RF signals in directions parallel, perpendicular or both to first and second radiating members 510 and 511, respectively. When operating in the third frequency band, first, second and third radiating members 510, 511 and 512, respectively, of compact multiple-band antenna 500 cooperatively receive and substantially radiate RF signals in directions parallel, perpendicular or both to first, second and third radiating members 510, 511 and 512, respectively. When operating in the fourth frequency band, fourth radiating member 513 of compact multiple-band antenna 500 receives and substantially radiates RF signals in directions parallel, perpendicular or both to fourth radiating member 513.

In another embodiment, first, second and third radiating members 510, 511 and 512, respectively, of compact multiple-band antenna 500 function as a loop antenna. A loop antenna provides usable radiation properties when operating at its resonance frequencies. The RF signal is fed or taken between first and second feed points 504 and 505, respectively, of feeding device 503. When operating in the first, second and third frequency bands, first, second and third radiating members 510, 511 and 512, respectively, of compact multiple-band antenna 500 cooperatively receive and substantially radiate RF signals in directions parallel, perpendicular or both to first, second and third radiating members 510, 511 and 512, respectively. When operating in the fourth frequency band, fourth radiating member 513 of compact multiple-band antenna 500 receives and substantially radiates RF signals in directions parallel, perpendicular or both to fourth radiating member 513.

In the current embodiment, first radiating member 510 has a first end, an intermediate portion and a second end. The first end of first radiating member 510 is electrically connected to the second end of shorting member 506. The intermediate portion of first radiating member 510 is electrically connected to first feed point 504 of feeding device 503. The second end of first radiation member 510 is electrically connected to the first end of second radiating member 511. First radiating member 510 is primarily associated with a first resonant frequency. The first resonant frequency can correspond, for instance, to a frequency within the frequency band defined for GSM. The length of first radiating member 510 can be approximately one-quarter the wavelength of the first resonant frequency. One skilled in the art will appreciate that the length of a radiating member of the present disclosure is not limited to one-quarter the wavelength of the desired resonant frequency, but other lengths may be chosen, such as one-half the wavelength of the desired resonant frequency. First radiating member 510 can be L-shaped, meandered or other similar configurations to allow for a smaller antenna size.

Second radiating member 511 has a first end and a second end. The first end of second radiating member 511 is electrically connected to the second end of first radiating member 510. The second end of second radiating member 511 is electrically connected to the first end of third radiating member 512. Second radiating member 511 is primarily associated with a second resonant frequency. The second resonant frequency can correspond, for instance, to a frequency within the frequency band defined for DCS. The length of second radiating member 511 can be approximately one-quarter the wavelength of the second resonant frequency. Second radiating member 511 can be L-shaped, meandered or other similar configuration to allow for a smaller antenna size.

Third radiating member 512 has a first end and a second end. The first end of third radiating member 512 is electrically connected to the second end of second radiating member 511, and the second end of third radiating member 512 is electrically connected to the first end of fourth radiating member 513. Third radiating member 512 is primarily associated with the third resonant frequency. The third resonant frequency can correspond, for instance, to a frequency within the frequency band defined for PCS, UMTS, LTE, WiBro, Bluetooth, WLAN or GPS. The length of third radiating member 512 can be approximately one-quarter the wavelength of the third resonant frequency. Third radiating member 512 can be L-shaped, meandered or other similar configuration to allow for a smaller antenna size.

Fourth radiating member 513 has a first end, an intermediate portion and a second end. The first end of fourth radiating member 513 is electrically connected to the second end of third radiating member 512. The intermediate portion of fourth radiating member 513 is electrically connected to second feed point 505 of feeding device 503. The second end of fourth radiating member 513 is a free end and unconnected. Fourth radiating member 513 is primarily associated with a fourth resonant frequency. The fourth resonant frequency can correspond, for instance, to a frequency within the frequency band defined for WLAN. The length of fourth radiating member 513 can be approximately one-quarter the wavelength of the fourth resonant frequency. Fourth radiating member 513 can be L-shaped, meandered or other similar configuration to allow for a smaller antenna size.

Shorting member 506 has a first end and a second end. The first end of shorting member 506 is electrically connected to ground area 501 and the second end of shorting member 506 is electrically connected to the first end of first radiating member 510. Further, shorting member 506 can be L-shaped, meandered or other similar configurations to allow for a smaller antenna size. Shorting member 506 provides further tuning for input impedance matching. Tuning of the input impedance of an antenna typically refers to matching the impedance seen by an antenna at its input terminals such that the input impedance is purely resistive with no reactive component. According to the present disclosure, the matching of the input impedance can be adjusted by changing the length, width or both of shorting member 506.

The function of a stub member includes modifying the frequency bandwidth of a radiating member, providing further impedance matching for a radiating member or providing reactive loading to modify the resonant frequencies of a radiating member or any combination thereof. First stub member 520 has a first end and a second end. The first end of first stub member 520 is electrically connected to second end of second radiating member 511, while the second end of first stub member 520 is a free end and unconnected. In the current embodiment, first stub member 520 provides further impedance matching for second radiating member 511.

Second stub member 521 has a first end and a second end. The first end of second stub member 521 is electrically connected to the second end of third radiating member 512, while the second end of second stub member 521 is a free end and unconnected. In the current embodiment, second stub member 521 provides further impedance matching for third radiating member 512.

Third stub member 522 has a first end and a second end. The first end of third stub member 522 is electrically connected to the first end of fourth radiating member 513, while the second end of third stub member 522 is a free end and unconnected. In the current embodiment, third stub member 522 provides further impedance matching for fourth radiating member 513.

The function of a coupling slot includes physically partitioning the radiating member into a subset of radiating members, providing reactive loading to modify the resonant frequencies of a radiating member, modifying the frequency bandwidth of a radiating member, providing further impedance matching for a radiating member or controlling the polarization characteristics or any combination thereof. In the current embodiment, first, fourth and sixth coupling slots 530, 533 and 535, respectively, can provide further impedance matching for radiating member 510. First coupling slot 530 is bordered by first radiating member 510 and ground area 501. Fourth coupling slot 533 is bordered by first radiating member 510 and fourth radiating member 513. Sixth coupling slot 535 is bordered on one side by third stub member 522 and on the other side by shorting member 506 and first radiating member 510. In other embodiments, sixth coupling slot 535 can be bordered on one side by third stub member 522 and the other side by first radiating member 510, shorting member 506 or ground area 501 or any combination thereof. The strength of the capacitive coupling, inductive coupling or both can be modified by varying the length, width or both of first, fourth and sixth coupling slots 530, 533 and 535, respectively.

In the current embodiment, second coupling slot 531 can provide further impedance matching for third radiating member 512. Second coupling slot 531 is bordered on both sides by third radiating member 512. In other embodiments, second coupling slot 531 can be bordered on one side by third radiating member 512 and on the other side by third radiating member 512, fourth radiating member 513, first stub member 520, second stub member 521, shorting member 506 or ground area 501 or any combination thereof. The strength of the capacitive coupling, inductive coupling or both can be modified by varying the length, width or both of second coupling slot 531.

Third and fifth coupling slots 532 and 534, respectively, may provide further input impedance matching. Third coupling slot 532 is bordered on one side by third radiating member 512 and second stub member 521 and on the other side by shorting member 506. In other embodiments, third coupling slot 532 can be located between any combination of third radiating member 512, second stub member 521, shorting member 506 and ground area 501. Fifth coupling slot 534 is located between shorting member 506 and ground area 501. The strength of the capacitive coupling, inductive coupling or both can be modified by varying the length, width or both of third and fifth coupling slots 532 and 534, respectively.

Fourth and sixth coupling slots 533 and 535 may provide further impedance matching for fourth radiating member 513. Fourth coupling slot 533 is bordered on one side by fourth radiating member 513 and the other side by first radiating member 510. Sixth coupling slot 535 is bordered on one side by third stub member 522 and the other side by shorting member 506 and first radiating member 510. In other embodiments, sixth coupling slot 535 can be bordered on one side by third stub member 522 and the other side by first radiating member 510, shorting member 506 or ground area 501 or any combination thereof. The strength of the capacitive coupling, inductive coupling or both can be modified by varying the length, width or both of fourth and sixth coupling slots 533 and 535, respectively.

Further, one skilled in the art will appreciate that the strength of the capacitive coupling, inductive coupling or both can also be modified by varying the area of the surfaces of first, second, third and fourth radiating members 510, 511, 512 and 513, respectively; first, second and third stub members 520, 521 and 522, respectively; shorting member 506 and ground area 501. Further, the angle of these surfaces and the distance between these surfaces will affect the capacitive coupling, inductive coupling or both.

Figure 6:
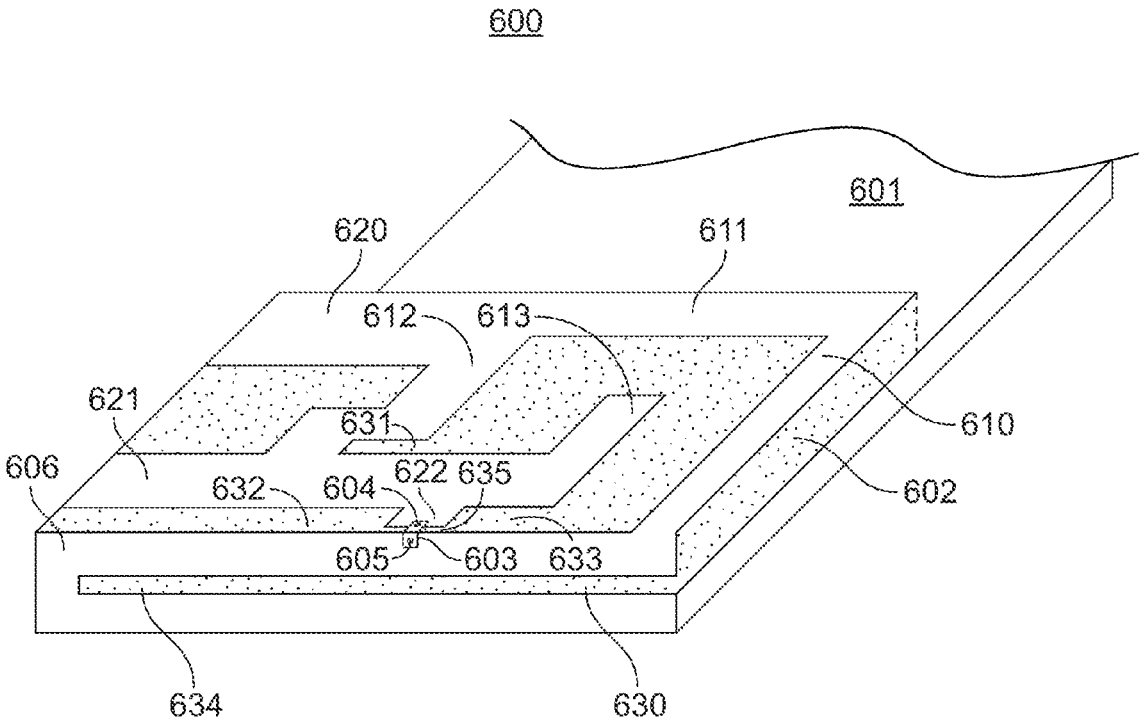
FIG. 6 illustrates an isometric view of one embodiment of a compact multiple-band antenna that can be employed in a wireless device in accordance with various aspects set forth herein.

FIG. 6 illustrates an isometric view of one embodiment of compact multiple-band antenna 600 that can be employed in wireless device 101 in accordance with various aspects set forth herein. Compact multiple-band antenna 600 maybe fabricated from, for instance, a sheet of conductive materials such as aluminum, copper, gold or silver using a stamping process or any other fabrication techniques such as depositing a conductive film on a substrate or etching previously deposited conductor from a substrate.

In this embodiment, ground area 601 forms a first surface of compact multiple-band antenna 600. Compact multiple-band antenna 600 includes bent portions of shorting member 606 and first radiating member 610. Shorting member 606 and a portion of first radiating member 610 form a second surface, which is approximately perpendicular to the first surface. First feed point 604 of feeding device 603 is electrically connected to the portion of first radiating member 610 of the second surface. The other portion of first radiating member 610; second, third and fourth radiating members 611, 612 and 613, respectively; first, second and third stub members 620, 621 and 622, respectively, form a third surface, which is approximately perpendicular to the second surface and approximately parallel to the first surface. In another embodiment, first, second and third stub members 620, 621 and 622, respectively, may be bent approximately perpendicular to the second surface. Second feed point 605 of feeding device 603 is electrically connected to fourth radiating member 613 of the third surface.

Dielectric material 602 is predominantly used to further isolate first, second, third and fourth radiating members 610, 611, 612 and 613, respectively, from ground area 601. Dielectric material 602 is bordered on one side by ground area 601 and on the other side by the other portion of first radiating member 610, second, third and fourth radiating members 611, 612 and 613, respectively, and first, second and third stub members 620, 621 and 622, respectively. Dielectric material 602 can be, for example, the air, a substrate or a polystyrene or any combination thereof. The first, second or third surfaces or any combination thereof can be non-planar or positioned in such a way that the perpendicular distance, parallel distance or both distances to other surfaces is non-constant. Further, first, second or third surfaces or any combination thereof can be integrated in the housing of wireless device 101.

First coupling slot 630 is bordered on one side by first radiating member 610 and on the other side by ground area 601, and resides on the same plane as the second surface. Second coupling slot 631 is bordered on both sides by third radiating member 612, and resides on the same plane as the third surface. Third coupling slot 632 is bordered on one side by third radiating member 612 and second stub member 621 and on the other side by shorting member 606, and resides on the same plane as the third surface. Fourth coupling slot 633 is bordered by first radiating member 610 and fourth radiating member 613, and resides on the same plane as the third surface. Fifth coupling slot 634 is bordered on one side by shorting member 606 and on the other side by ground area 601, and resides on the same plane as the second surface. Sixth coupling slot 635 is bordered on one side by third stub member 622 and the other side by shorting member 606 and first radiating member 610, and resides on the same plane as the third surface.

Figure 7:
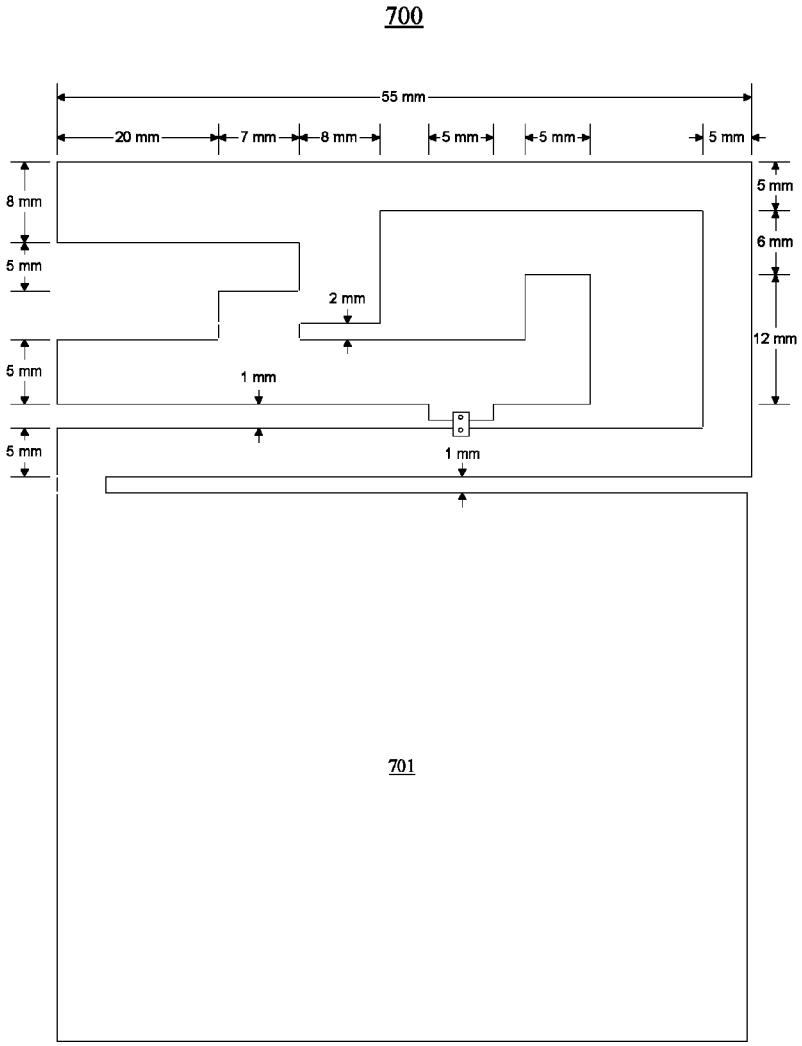
FIG. 7 illustrates dimensions of the compact multiple-band antenna of FIG. 5.

FIG. 7 illustrates significant dimensions of an exemplary prototype embodiment of compact multiple-band antenna 500 of wireless device 101. The graphical illustration in its entirety is referred to by 700. The dimensions are given in millimeters, and the antenna embodiment of FIG. 7 is intended to be an embodiment suitable for quad-band operation in, for example, the GSM, DCS, PCS and WLAN frequency bands.

Figure 8:
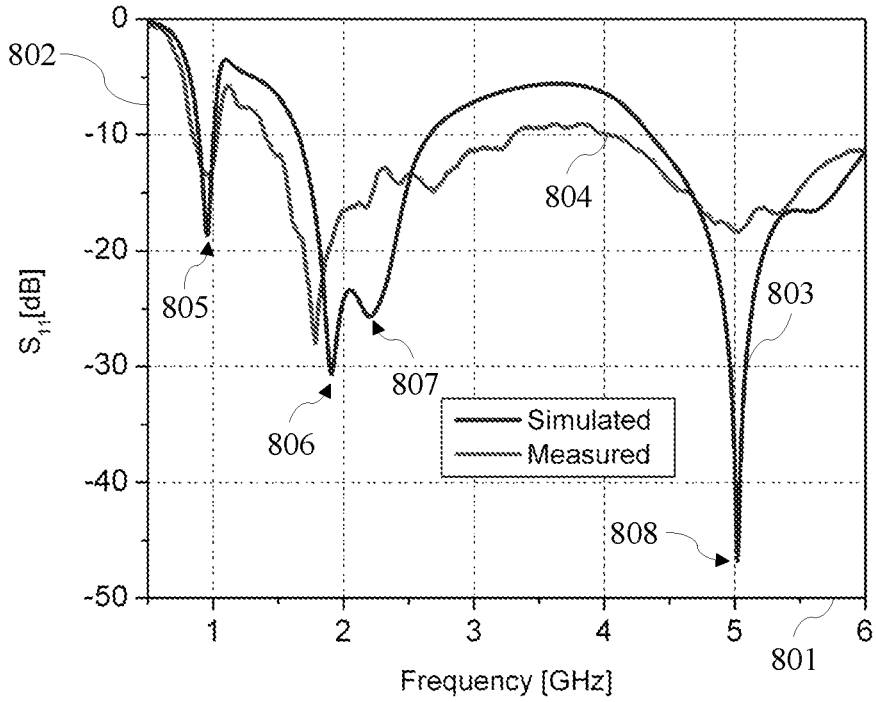
FIG. 8 illustrates measured and simulated results for the compact multiple-band antenna of FIG. 5.

FIG. 8 shows a graphical illustration of the measured and simulated form of the reflection coefficient $S_{11}$ for compact multiple-band antenna 500 of wireless device 101. The graphical illustration in its entirety is referred to by 800. The frequency from 500 MHz to 6 GHz is plotted on the abscissa 801. The logarithmic magnitude of the input reflection factor $S_{11}$ is shown on the ordinate 802 and is plotted in the range from 0 dB to −50 dB. Graph 803 shows the simulated input reflection factor $S_{11}$ for compact multiple-band antenna 500. Graph 803 shows resonant frequencies 805, 806, 807 and 808 associated with first, second, third and fourth radiating members 510, 511, 512 and 513, respectively, of compact multiple-band antenna 500, which reside within the frequency bands corresponding to, for example, GSM, DCS, Bluetooth and WLAN, respectively. Graph 804 shows the measured input reflection factor $S_{11}$ for a prototype of compact multiple-band antenna 500.

It is important to note that persons having ordinary skill in the art would appreciate that this disclosure is in no way limited to the operating frequency bands or the resonant frequencies described, or to any specific interrelationship between the operating frequency bands or resonant frequencies associated with each member in the exemplary multiple-band antennas.

Having shown and described exemplary embodiments, further adaptations of the methods, devices and systems described herein may be accomplished by appropriate modifications by one of ordinary skill in the art without departing from the scope of the present disclosure. Several of such potential modifications have been mentioned, and others will be apparent to those skilled in the art. For instance, the exemplars, embodiments, and the like discussed above are illustrative and are not necessarily required. Accordingly, the scope of the present disclosure should be considered in terms of the following claims and is understood not to be limited to the details of structure, operation and function shown and described in the specification and drawings.

As set forth above, the described disclosure includes the aspects set forth below.

The invention claimed is:

1. A multiple-band antenna for a wireless device, comprising:

a ground area;

a coaxial connect;

a first radiating member having a first end, an intermediate portion, and a second end and cooperatively receiving and substantially radiating RF signals at a first, second, and third resonant frequencies, wherein said first end of said first radiating member is electrically connected to said ground area and said intermediate portion of said first radiating member is electrically connected to a first feed point;

a second radiating member having a first end and a second end and cooperatively receiving and substantially radiating RF signals at said first, second, and third resonant frequencies, wherein said first end of said second radiating member is electrically connected to said second end of said first radiating member;

a third radiating member having a first end and a second end and cooperatively receiving and substantially radiating RF signals at said first, second, and third resonant frequencies, wherein said first end of said third radiating member is electrically connected to said second end of said second radiating member; and a fourth radiating member having a first end, an intermediate portion, and a second end and providing a fourth resonant frequency, wherein said first end of said fourth radiating member is electrically connected to said second end of said third radiating member, said intermediate portion of said fourth radiating member is electrically connected to a second feed point, wherein said first feed point and said second feed point are both connected through said coaxial connector to a transmitter, a receiver, or both.

2. The multiple-band antenna of claim 1, further comprising:

a dielectric material set between a portion of said first radiating member and said second radiating member, third radiating member, fourth radiating member, or any combination thereof, and said ground area.

3. The multiple-band antenna of claim 1, wherein said first feed point and said second feed point are differentially and electrically connected to said transmitter, said receiver, or both.

4. The multiple-band antenna of claim 1, wherein said first feed point is electrically connected to a first conductor of the coaxial connector, and said second feed point is electrically connected through a feeding device to said first conductor of said coaxial connector.

5. The multiple-band antenna of claim 1, further comprising:

a first stub member having a first end and a second end and used for modifying the frequency bandwidth, providing further impedance matching, tuning said second resonant frequency, or any combination thereof for said second radiating member, wherein said first end of said first stub member is electrically connected to said second end of said second radiating member, and said second end of said first stub member is unconnected.

6. The multiple-band antenna of claim 1, further comprising:

a second stub member having a first end and a second end and used for modifying the frequency bandwidth, providing further impedance matching, tuning said third resonant frequency, or any combination thereof for said third radiating member, wherein said first end of said second stub member is electrically connected to said third radiating member, and said second end of said second stub member is unconnected.

7. The multiple-band antenna of claim 1, further comprising:

a third stub member having a first end and a second end and used for modifying the frequency bandwidth, providing further impedance matching, tuning said fourth resonant frequency, or any combination thereof for said fourth radiating member, wherein said first end of said third stub member is electrically connected to said fourth radiating member, and said second end of said third stub member is unconnected.

8. The multiple-band antenna of claim 1, further comprising:

a shorting member having a first end and a second end and used for providing further input impedance matching, wherein said shorting member is positioned between said first feed point and said ground area with said first end of said shorting member electrically connected to said ground area, and said second end of said shorting member electrically connected to said first end of said first radiating member.

9. The multiple-band antenna of claim 1, further comprising:

a first coupling slot for modifying the frequency bandwidth, providing further impedance matching, tuning said first resonant frequency, or any combination thereof of said first radiating member, wherein said first coupling slot is positioned between said first radiating member and said ground area.

10. The multiple-band antenna of claim 1, wherein said third radiating member is meandered to reduce the overall height of said antenna, tune said third resonant frequency, or both.

11. The multiple-band antenna of claim 1, wherein said fourth resonant frequency is further adjusted by changing the location of said second feed point.

12. A multiple-band antenna for a wireless device, comprising:

a ground area;

a coaxial connector;

a first radiating member having a first end, an intermediate portion and providing a first resonant frequency, wherein said first end of said first radiating member is electrically connected to said ground area and said intermediate portion is electrically connected to a first feed point;

a second radiating member having a first end and a second end and providing a second resonant frequency, wherein said first end of said second radiating member is electrically connected to said second end of said first radiating member;

a third radiating member having a first end and a second end and providing a third resonant frequency, wherein said first end of said third radiating member is electrically connected to said second end of said second radiating member;

a fourth radiating member having a first end, an intermediate portion and a second end and providing a fourth resonant frequency, wherein said first end of said fourth radiating member is electrically connected to said second end of said third radiating member, said intermediate portion of said fourth radiating member is electrically connected to a second feed point, wherein said first feed point and said second feed point are both connected through said coaxial connector to a transmitter, a receiver, or both.

13. The multiple-band antenna of claim 1, wherein said second end of said fourth radiating member is cantilevered from the intermediate portion.

* * * * *